US009217343B2

(12) United States Patent
Rice et al.

(10) Patent No.: US 9,217,343 B2
(45) Date of Patent: Dec. 22, 2015

(54) DUAL FLOW CHECK VALVE FOR POSITIVE CRANKCASE VENTILATION SYSTEM

(71) Applicant: GM GLOBAL TECHNOLOGY OPERATIONS LLC, Detroit, MI (US)

(72) Inventors: Alan E. Rice, New Baltimore, MI (US); Steven G. Bryde, Davisburg, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 62 days.

(21) Appl. No.: 13/943,110

(22) Filed: Jul. 16, 2013

(65) Prior Publication Data

US 2015/0020784 A1 Jan. 22, 2015

(51) Int. Cl.
*F02M 13/00* (2006.01)
*F01M 13/00* (2006.01)

(52) U.S. Cl.
CPC ..... *F01M 13/0011* (2013.01); *Y10T 137/7904* (2015.04)

(58) Field of Classification Search
CPC ..... F01M 13/011; F01M 13/0033; F01M 2013/0044; F01M 2013/005; F01M 2013/0494
USPC ..... 123/572; 137/528; 29/888
See application file for complete search history.

(56) References Cited

U.S. PATENT DOCUMENTS

| | | | | |
|---|---|---|---|---|
| 40,279 | A * | 10/1863 | Raymond | 114/197 |
| 3,931,011 | A * | 1/1976 | Richards et al. | 210/136 |
| 4,655,247 | A * | 4/1987 | Westra et al. | 137/519.5 |
| 2001/0054418 | A1 * | 12/2001 | Burgess | 123/572 |
| 2003/0131903 | A1 * | 7/2003 | Healy | 141/45 |
| 2004/0011398 | A1 * | 1/2004 | Davies et al. | 137/114 |
| 2004/0035403 | A1 * | 2/2004 | Pateman et al. | 123/574 |
| 2005/0193562 | A1 * | 9/2005 | Andra et al. | 29/890.122 |
| 2012/0048401 | A1 * | 3/2012 | Yamashita et al. | 137/528 |

OTHER PUBLICATIONS

Chris Woodford, Aluminum, Mar. 8, 2012, Explainthatstuff, https://web.archive.org/web/20120308062045/http://www.explainthatstuff.com/aluminum.html.*

* cited by examiner

*Primary Examiner* — Lindsay Low
*Assistant Examiner* — Kevin Lathers
(74) *Attorney, Agent, or Firm* — Quinn Law Group, PLLC

(57) ABSTRACT

A dual flow check valve includes a valve body having an inner valve cavity, a first valve opening, and a second valve opening. The dual flow check valve further includes a seal disposed within the valve body. The seal is operatively coupled within the valve body such that the seal is configured to move relative to the valve body between an open position, in which the seal allows the gas to flow between the first and second valve openings through the inner valve cavity, and a closed position, in which the seal inhibits the gas and the liquid from flowing through the inner valve cavity from the first valve opening to the second valve opening.

12 Claims, 2 Drawing Sheets

DUAL FLOW CHECK VALVE FOR POSITIVE CRANKCASE VENTILATION SYSTEM

TECHNICAL FIELD

The present disclosure relates to dual flow check valves for positive crankcase ventilation systems.

BACKGROUND

Internal combustion engines may combust a mixture of air and fuel in cylinders to drive torque. During engine operation, combustion gas may leak between the cylinder and the corresponding piston rings and into the engine crankcase. The leaked combustion gas is referred to as blowby gas and typically includes intake air, unburned fuel, exhaust gas, oil mist, and water vapor. In an effort to ventilate the crankcase and recirculate the blowby gas to the intake side of the engine, a positive crankcase ventilation (PCV) system may be used.

SUMMARY

The present disclosure relates to dual flow check valves. In an embodiment, the dual flow check valve includes a valve body having an inner valve cavity, a first valve opening leading to the inner valve cavity, and a second valve opening leading to the inner valve cavity. The inner valve cavity fluidly couples the first valve opening with the second valve opening. The dual flow check valve further includes a seal disposed within the valve body. The seal is configured to be buoyant in a liquid and remains stationary in relation to the valve body when a gas flows between the first valve opening and the second valve opening through the inner valve cavity. The seal is operatively coupled within the valve body such that the seal is configured to move relative to the valve body between an open position, in which the seal allows the gas to flow between the first and second valve openings through the inner valve cavity, and a closed position, in which the seal inhibits the gas and the liquid from flowing through the inner valve cavity from the first valve opening to the second valve opening.

In an embodiment, the seal may be configured to be buoyant in oil. The seal may be substantially hollow. For example, the seal may be a substantially hollow aluminum ball.

In an embodiment, the dual flow check valve may further include a base fixed within the valve body. The base is configured to support the seal when the seal is in the open position. The base may include a base body defining a recess. The recess may be configured and sized to partially receive the seal. The base body defines an outer body perimeter. The base further includes a rim coupled to the base body along the outer body perimeter. The rim is coupled to the valve body. The base has a plurality of holes each extending through the rim. Each hole is configured to allow the gas to flow between the first and second valve openings through the inner valve cavity. The rim may be substantially disk-shaped. The plurality of holes may be arranged circumferentially along the rim.

In an embodiment, the dual flow check valve may further comprise at least one wall supported by a portion of the base such as the rim. The wall is disposed within the valve body such as to guide the movement of the seal when the seal moves between the open position and the closed position. The valve body defines an inner valve surface that defines at least the inner valve cavity. The wall may be disposed between the inner valve surface and the seal.

The present disclosure also relates to engine assemblies. In an embodiment, the engine assembly includes an engine having a combustion chamber and a crankcase chamber. The intake assembly includes an intake manifold fluidly coupled with the combustion chamber. The engine assembly further includes a dual flow check valve fluidly coupled between the crankcase chamber and the intake manifold. The dual flow check valve includes a valve body having an inner valve cavity. The inner valve cavity is disposed in fluid communication with the crankcase chamber and the intake manifold. The dual flow check valve further includes a seal disposed within the valve body. The seal is configured to be buoyant in oil and to remain stationary in relation to the valve body when a gas flows along the seal through the inner valve cavity. The seal is operatively coupled within the valve body such that the seal is configured to move relative to the valve body between an open position, in which the seal allows the gas to flow between the crankcase chamber and the intake manifold through the inner valve cavity, and a closed position, in which the seal inhibits the gas and the oil from flowing from the crankcase chamber into the intake manifold through the inner valve cavity.

In an embodiment, seal may be a substantially hollow metallic sphere.

In an embodiment, the engine assembly further includes a base disposed within the valve body. The base is configured to support the seal and has a plurality of holes. Each hole is configured to allow the gas to flow along the seal through the inner valve cavity. The engine assembly may further include a plurality of walls disposed in the valve body. The walls are disposed around the seal to maintain the seal spaced apart from the holes.

The present disclosure also relates to methods of manufacturing an engine assembly. In one exemplary embodiment, the method includes fluidly coupling a combustion chamber of an engine with an intake manifold of an intake assembly. The engine has a crankcase chamber. The crankcase chamber contains oil. The method further includes fluidly coupling a dual flow check valve between the crankcase chamber and the intake manifold. The dual check valve is configured to allow bidirectional flow of gas between the crankcase chamber and the intake manifold while also preventing oil from flowing from the crankcase chamber into the intake manifold.

The above features and advantages, and other features and advantages, of the present invention are readily apparent from the following detailed description of some of the best modes and other embodiments for carrying out the invention, as defined in the appended claims, when taken in connection with the accompanying drawings.

DETAILED DESCRIPTION

Figure 1:
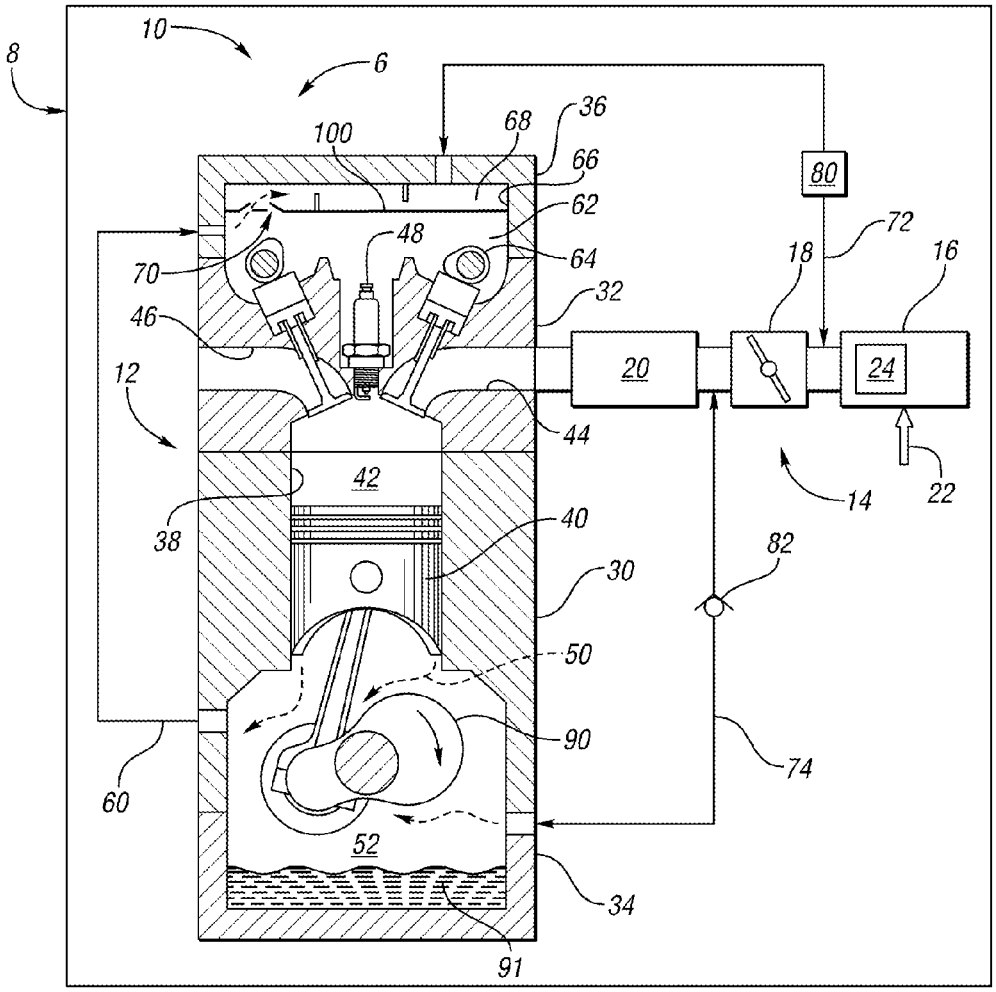
FIG. 1 is a schematic partial cross-sectional illustration of a positive crankcase ventilation system operating with an engine assembly.

Referring to the drawings, wherein like reference numerals are used to identify like or identical components in the various views, FIG. 1 schematically illustrates a vehicle 8 including an engine assembly 10 configured to drive a transmission (not shown). The engine assembly 10 includes an engine 12 and an intake assembly 14 disposed in fluid communication with the engine 12. The intake assembly 14 may include, for example, an air cleaner assembly 16, a throttle 18, and an intake manifold 20 disposed in a series arrangement. The throttle 18 may be disposed between the air cleaner assembly 16 and the intake manifold 20 and may be configured to selectively restrict the flow of air 22 into the intake manifold 20. The air cleaner assembly 16 may include housings, ports, and/or conduits that may be located upstream of the throttle 18. In one configuration, the air cleaner assembly 16 may include, for example, an air filter 24 with a sufficient porosity or other construction to filter airborne debris from the intake air 22 prior to its passage into the intake manifold 20.

The engine 12 may include an engine block 30, a cylinder head 32, an oil pan 34, and an engine cylinder head cover 36. The engine block 30 may have a plurality of cylinder bores 38 (one of which is shown), with each cylinder bore 38 containing a reciprocating piston 40 disposed therein. The plurality of cylinder bores 38 may be arranged in any suitable manner, such as, without limitation, a V-engine arrangement, an inline engine arrangement, and a horizontally opposed engine arrangement, as well as using both overhead cam and cam-in-block configurations.

The cylinder head 32, engine block 30, and reciprocating piston 40 may cooperate to define a combustion chamber 42 for each respective cylinder bore 38. Additionally, the cylinder head 32 may provide one or more intake passages 44 and exhaust passages 46 in selective fluid communication with the combustion chamber 42. The intake passage 44 may be used to deliver an air/fuel mixture to the combustion chamber 42 from the intake manifold 20. Following combustion of the air/fuel mixture (such as when ignited by a spark from a spark plug 48), the exhaust passage 46 may carry exhaust gasses out of the combustion chamber 42.

During engine operation, an intake stroke of the piston 40 may draw intake air 22 through the air cleaner assembly 16, past the throttle 18, through the intake manifold 20 and intake passage 44, and into the combustion chamber 42, where fuel may be introduced via fuel injectors (not shown). During the power stroke of the piston 40, following the ignition of the air/fuel mixture in the combustion chamber 42, a portion of the combustion gas may pass between the piston 40 and the engine block 30 (i.e., blowby gas 50) and into the crankcase chamber 52 (the crankcase chamber 52 being generally defined by the engine 12 via the oil pan 34 and engine block 30). Because the blowby gas 50 includes an amount of unburnt fuel and products of combustion (such as water vapor), it may be desirable to avoid having these gasses accumulate within the crankcase chamber 52. Accordingly, a positive crankcase ventilation (PCV) system 6 may be used to purge the blowby gas 50 from the crankcase chamber 52.

The PCV system 6 may utilize ducting, passageways, and/or chambers that may actively vent the blowby gas 50 from the crankcase chamber 52 into the intake system 14, where it may eventually be exhausted via the exhaust passage 46. More specifically, the PCV system 6 may include a first fluid conduit 60 that may fluidly couple the crankcase chamber 52 with a camshaft chamber 62 defined by the cylinder head cover 36. The camshaft chamber 62 may contain one or more rotating camshafts 64 that are configured to translate one or more valves.

Adjacent to the camshaft chamber 62, the PCV system 6 may include an air-oil separator 66 that generally defines a separator chamber 68. In one configuration, the separator chamber 68 may be fluidly coupled with the camshaft volume 62 through a plurality of ports 70. The separator chamber 68 may be fluidly coupled with the intake manifold 20 through a second fluid conduit 72. Additionally, the crankcase chamber 52 may be coupled with the air cleaner assembly 16 through a third fluid conduit 74. A check valve 82 may be positioned in line with the third fluid conduit 74 to prevent back flow from the crankcase chamber 52 to intake assembly 14. Depending on the configuration of the engine 12, the first fluid conduit 60 may be, for example, a bore or channel within the engine 12 or a tube that extends between the crankcase chamber 52 and the separator 66.

When the engine 12 is operated at moderate engine speeds and loads, the intake stroke of the engine 12 may generate a vacuum in the intake manifold 20 as a result of the throttle 18 partially blocking the intake air flow 22. This vacuum may draw the blowby gas 50 from the crankcase chamber 52 through both the camshaft chamber 62 and the separator chamber 68 and into the intake manifold 20 via the first and second fluid conduits 60, 72. As such, the pressure differential across the throttle 18 may generate a motive force that may actively vent the crankcase chamber 52. During conditions when the engine 12 is operated at low load or idle conditions, the pressure differential between the crankcase chamber 52 and the combustion chamber 42 causes the PCV system 6 to draw filtered air 22 from the air cleaner assembly 16 and into the separator chamber 68 and the camshaft chamber 62 through second fluid conduit 72, thereby mixing filtered ambient air 22 with blowby gases 50. During conditions when the engine 12 is operated at high engine speeds and high loads, there will be reduced vacuum in the intake manifold 20 as a result of the open throttle 18 drawing high intake air flow 22. The blowby gas 50 from the crankcase chamber 52 will flow through both the camshaft chamber 62 and the separator chamber 68 and into the intake manifold 20 and the air cleaner assembly 16 via the first and second fluid conduits 60, 72 respectively. As such, the higher pressure in the crankcase chamber 52 may generate a motive force that may actively vent the crankcase chamber 52.

In a condition in which fuel is no longer being provided to the engine 12 (e.g., during an extreme deceleration such as braking to reduce fuel consumption, during operation from electric power in a hybrid vehicle or during cylinder deactivation), the piston 40 may still pump within the cylinder bore 38. This pumping without associated combustion may create a pressure differential between the crankcase chamber 52 and combustion chamber 42, which may cause oil 91 to flow from the crankcase chamber 52 into the intake manifold 20. In addition, vibration and sudden movements of the engine 12 (for example in racing conditions) can cause oil 91 to flow from the crankcase chamber 52 into the intake manifold 20. It is desirable to prevent, or at least inhibit, oil 91 from reaching the intake manifold 20. It is also desirable to allow gas (such as air 22 and blowby gas 50) to flow between the intake manifold 20 and the crankcase chamber 52 in any direction to minimize the pressure in the crankcase chamber 52. To prevent, or at least hinder, oil or any other suitable liquid 91 from flowing from the crankcase chamber 52 into the intake manifold 20, one or more dual flow check valves 80 may be positioned in line with the second fluid conduit 72 or any other conduit fluidly coupled between the intake manifold 20 (or any other part of the intake assembly 14) and the crankcase chamber 52.

Figure 2:
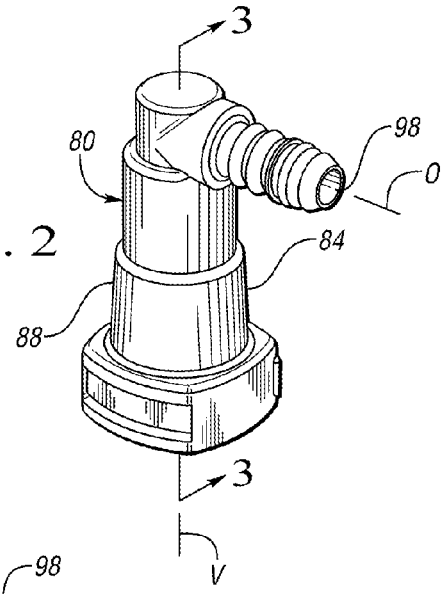
FIG. 2 is a perspective view of a dual flow check valve of the positive crankcase ventilation system shown in FIG. 1.
Figure 3:
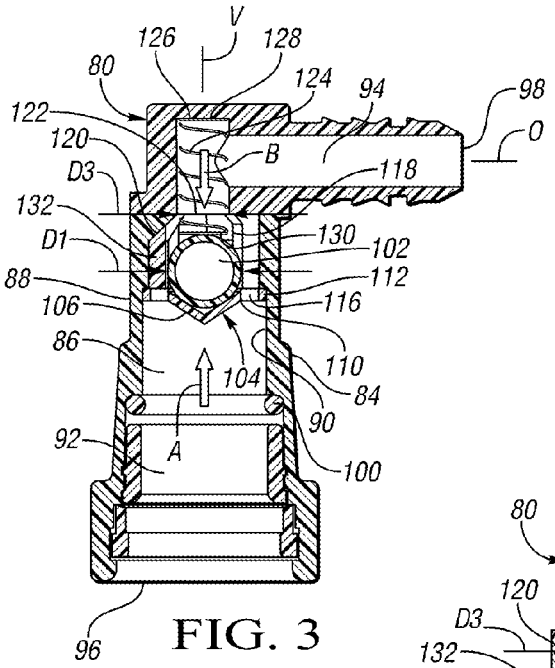
FIG. 3 is a side cross-sectional view of the dual flow check valve shown in FIG. 2, taken along section line 3-3 of FIG. 2, depicting a base and a seal disposed in an open position.
Figure 4:
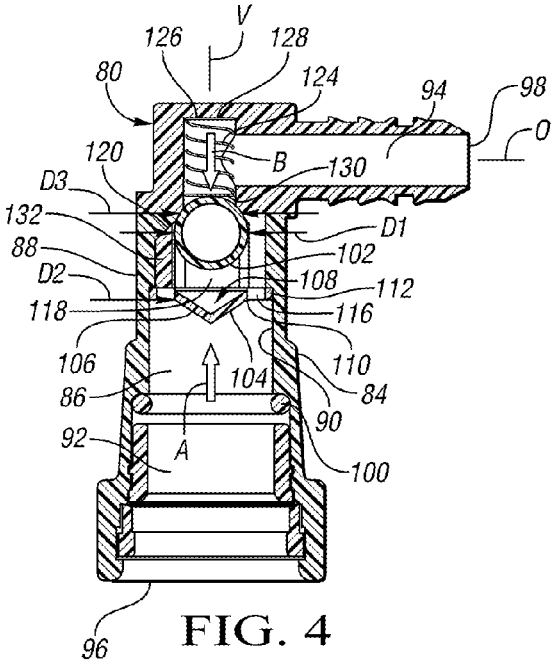
FIG. 4 is a side cross-sectional view of the dual flow check valve shown in FIG. 2, taken along section line 3-3 of FIG. 2, depicting the seal disposed in a closed position.

With reference to FIGS. 2-4, the dual flow check valve 80 includes a valve body 84 defining an inner valve cavity 86. The valve body 84 has an outer valve surface 88 and an inner valve surface 90 opposite the outer valve surface 88. The inner valve surface 90 defines the inner valve cavity 86. The inner valve cavity 86 may include a first cavity portion 92 elongated along a first valve axis V and a second cavity portion 94 elongated along a second valve axis O. The first valve axis V may be substantially perpendicular to the second valve axis O. The inner valve cavity 86 may further include a third or intermediate cavity portion 118 disposed between the first cavity portion 92 and the second cavity portion 94. Accordingly, the third cavity portion 118 fluidly couples the first cavity portion 92 and the second cavity portion 94.

The valve body 84 may have a first valve opening 96 and a second valve opening 98 both leading to the inner valve cavity 86. Specifically, the first valve opening 96 directly leads to the first cavity portion 92, while the second valve opening 98 directly leads to the second cavity portion 94. Accordingly, the inner valve cavity 86 fluidly couples the first valve opening 96 with the second valve opening 98. The first valve opening 96 is configured to receive a portion of the second fluid conduit 72 to fluidly couple the second fluid conduit 72 (or any other fluid conduit) with the first cavity portion 92. The second valve opening 98 is configured to receive a portion of the second fluid conduit 72 to fluidly couple the second fluid conduit 72 (or any fluid conduit) to the second cavity portion 94. Specifically, the first valve opening 96 is configured to receive the portion of the second fluid conduit 72 that is closer to the crankcase chamber 52 (FIG. 1), while the second valve opening 98 is configured to receive the portion of the second fluid conduit 72 that is closer to the intake manifold 20 (FIG. 1). A sealing member 100, such as an O-ring, may be disposed in the inner valve cavity 86 to prevent, or at least hinder, fluid leakage when a portion of the second fluid conduit 72 is fluidly coupled with the first cavity portion 92. The sealing member 100 may be disposed in the first cavity portion 92.

The valve body 84 further includes a shoulder, seat or neck 120 at least partly surrounding the third cavity portion 118. The neck 120 defines a neck opening 122 in the third cavity portion 118 of the inner valve cavity 86. The cross-sectional dimension or diameter of the neck opening 122 may vary along the first valve axis V. For instance, the cross-sectional dimension or diameter of the neck opening 122 may decrease in a first direction indicated by arrow A. In the depicted embodiment, the neck opening 122 may have a minimum neck cross-sectional dimension or diameter D3.

The dual flow check valve 80 includes a base 104 disposed within the inner valve cavity 86. The base 104 is fixed within the valve body 84 and includes a base body 106 defining a recess 108 (FIG. 4). The recess 108 is configured, shaped and sized to receive at least a portion of the seal 102. Although the drawings depict the base body 106 having a substantially conical shape, the base body 106 may have other suitable shapes. Irrespective of its shape, the base body 106 defines an outer body perimeter 110. Given that the depicted base body 106 is substantially conical, the outer body perimeter 110 is a circumference.

In addition, the base 104 includes a lip, protrusion or rim 112 disposed along the outer body perimeter 110 of the base body 106. The rim 112 extends from the base body 106 in a direction away from the recess 108. A portion of the base 104, such as the rim 112, may be substantially disk-shaped. Due to the connection between the valve body 84 and the rim 112, the base 104 remains stationary in relation to the valve body 84.

Figure 5:
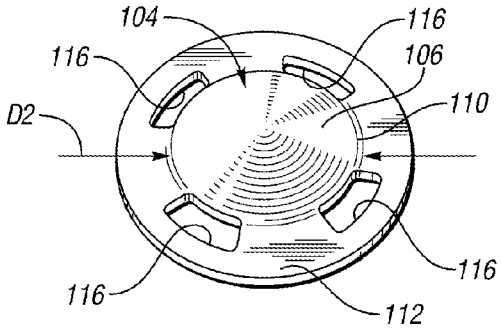
FIG. 5 is a bottom perspective view of the base shown in FIG. 3.

With reference to FIG. 5, the base 104 has one or more holes 116, extending therethrough. Specifically, the holes 116 may extend through the rim 112. The holes 116 may be arranged circumferentially along the base 104. In particular, the holes 116 may be arranged circumferentially along the rim 112. Notwithstanding that the drawings show four holes 116, the base 104 may have more or fewer holes 116. The holes 116 may be positioned equidistantly from one another. Each hole 116 is configured to permit fluid flow through the base 104. For example, each hole 116 is configured to allow gas (such as blowby gas 50) to flow between the first cavity portion 92 and the second cavity portion 94 (FIG. 3).

Referring again to FIGS. 2-4, the dual flow check valve 80 further includes a seal 102 configured and sized to block the neck opening 122 to prevent, or at least hinder, fluid flow between the first cavity portion 92 and the second cavity portion 94. The seal 102 is disposed within the valve body 84 between the first cavity portion 92 and the second cavity portion 94 and is configured to move through the inner valve cavity 86 and along the first valve axis V between a first or open position (FIG. 3) and a second or closed position (FIG. 4). In the open position, the seal 102 allows gas (such as air 22 and blowby gas 50) to flow from the first valve opening 96 to the second valve opening 98 and vice versa. In other words, when the seal 102 is in the open position, gas (such as air 22 and blowby gas 50) can flow through the inner valve cavity 86 in the first direction, which is indicated by arrow A, and in a second direction, which is indicated by arrow B. In the closed position, the seal 102 precludes, or at least hinders, fluid flow from the first valve opening 96 to the second valve opening 98.

In operation, the holes 116 allow gas (such as air 22 and blowby gas 50) to flow between the first valve opening 96 and the second valve opening 98 in the first direction, which is indicated by arrow A, and in the second direction, which is indicated by arrow B. While in the open position, the seal 102 rests on the base 104 without blocking the holes 116. Specifically, at least a portion of the seal 102 is disposed in the recess 108 while the remaining portions of the seal 102 do not extend laterally so as to cover the holes 116 and thereby impede fluid flow through the holes 116. Indeed, the seal 102 may define a maximum seal cross-sectional dimension or diameter D1 that is equal to or less than a maximum body cross-sectional dimension or diameter D2 defined by the outer body perimeter 110 of the base body 106, such that the seal 102 does not extend over the holes 116.

The seal 102 can be configured as a substantially hollow metallic ball or sphere. Thus, the seal 102 may have a substantially spherical shape. For example, the seal 102 can be configured as a substantially hollow aluminum ball. It is envisioned, however, that the seal 102 may have other suitable shapes and can be made of other suitable materials. Irrespective of its shape and construction, the seal 102 has a seal density that is higher than the gas density of the gas flowing through the inner valve cavity 86, thereby allowing the seal 102 to remain substantially stationary relative to the valve body 84 while gas flows through the holes 116 and along the seal 102 in any direction (e.g., in the first direction, which is indicated by arrow A, or in the second direction, which is indicated by arrow B). Thus, the seal density is greater than the gas density of the air 22, the blowby gas 50, or a mixture thereof. In other words, the seal density is greater than the gas density.

When a liquid, such as oil 91, flows through the holes 116 in the first direction, which is indicated by arrow A, the seal 102 moves along the valve axis V from the first or open position (FIG. 3) toward the second or closed position (FIG. 4). To facilitate movement of the seal 102, the seal 102 is configured to be buoyant in the liquid (such as the oil 91) that flows in the inner valve cavity 86. Thus, the seal density is less than the liquid density of the liquid flowing through the valve body 84. In other words, the liquid density is greater than the seal density. For example, the seal density is less than the oil density. In other words, the seal 102 is less dense than the oil 91 or any other liquid flowing through the inner valve cavity 86. Accordingly, when a liquid, such as oil 91, flows through the holes 116, the seal 102 floats on such liquid, and the liquid urges the seal 102 to move in the first direction indicated by arrow A. Continued flow of liquid, such as oil 91, through the holes 116 causes the seal 102 to move toward the neck opening 122 until the seal 102 reaches the closed position (FIG. 4). In the closed position, the seal 102 substantially closes the neck opening 122, thereby preventing, or at least hindering, gas and liquid flow through the neck opening 122. Thus, in the closed position, the seal 102 precludes, or at least inhibits, fluid flow between the first valve opening 96 and the second valve opening 98. The seal 102 can close the neck opening 122 because the maximum seal cross-sectional dimension or diameter D1 is greater than the minimum neck cross-sectional dimension or diameter D3. By stopping oil 91 from flowing from the first valve opening 96 to the second valve opening 98, the dual flow check valve 80 prevents the oil 91 from reaching the intake manifold 20 or any other part of the intake assembly 14.

As the liquid, such as the oil 91, recedes toward the first valve opening 96, the seal 102 can move from the closed position (FIG. 4) to the open position (FIG. 4) because the liquid is no longer pushing the seal 102 toward the neck opening 122. A biasing member, such as a spring 124, may be disposed in the third inner cavity 118 to bias the seal 102 toward the open position. The spring 124 may be connected between the inner valve surface 90 and the seal 102. In the depicted embodiment, the spring 124 includes a first spring end 126 coupled to an upper surface portion 128 of the inner valve surface 90 and a second spring end 130 coupled to the seal 102. Accordingly, the spring 124 is configured to bias the seal 102 in the second direction, which is indicated by arrow B, toward the open position. Once the seal 102 is in the open position, gas can flow through the holes 116 and between the first valve opening 96 and the second valve opening 98 in the first and second directions, which are indicated by arrows A and B, respectively.

To guide the motion of the seal 102 between the open and closed positions, the dual flow check valve 80 may include one or more walls disposed between the inner valve surface 90 and the seal 102. The walls 132 may be supported by a portion of the base 104, such as the rim 112, within the valve body 84 and may be disposed around the seal 130. Though the rim 112 supports the walls 132, no portion of the walls 132 blocks the holes 116 extending through the rim 112. The walls 132 may be circumferentially disposed along the rim 112 without blocking the holes 116. For example, one wall 132 may be disposed between each pair of holes 116. Moreover, the walls 132 maintain the seal 102 spaced apart from the holes 116, so that seal 102 does not obstruct fluid flow through the holes 116.

With reference again to FIG. 1, as discussed above, it is desirable to prevent, or at least hinder, oil 91 from reaching intake manifold 20 while allowing gas (such as air 22 and blowby gas 50) to flow between the intake manifold 20 and the crankcase chamber 52 in any direction. The dual flow check valve 80 allows bidirectional gas flow in the second fluid conduit 72, thereby minimizing the pressure in the crankcase chamber 52. In other words, the dual flow check valve 80 is configured to allow bidirectional gas flow between the intake manifold 20 of the intake assembly 14 and the crankcase chamber 52 while precluding, or at least inhibiting, oil 91 (or any other suitable liquid) from reaching the intake assembly 14. Hence, the dual flow check valve 80 is configured to prevent, or at least hinder, the oil 91 (or any other suitable liquid) from flowing from the crankcase chamber 52 into the intake manifold 20.

The present disclosure also relates to methods of manufacturing an engine assembly 10. This manufacturing method may include fluidly coupling the combustion chamber 42 of the engine 12 with the intake manifold 20 of the intake assembly 14. As discussed above, the engine 12 includes the crankcase chamber 52, which may contain oil 91. The manufacturing method further includes fluidly coupling the dual flow check valve 80 between the crankcase chamber 52 and the intake manifold 20. As described in detail above, the dual flow check valve 80 is configured to allow bidirectional flow of gas between the crankcase chamber 52 and the intake manifold 20 while preventing oil 91 from flowing from the crankcase chamber 52 to the intake manifold 20.

The detailed description and the drawings or figures are supportive and descriptive of the invention, but the scope of the invention is defined solely by the claims. While some of the best modes and other embodiments for carrying out the claimed invention have been described in detail, various alternative designs and embodiments exist for practicing the invention defined in the appended claims.

The invention claimed is:

1. A dual flow check valve comprising:

a valve body having an inner valve cavity, a first valve opening leading to the inner valve cavity, and a second valve opening leading to the inner valve cavity, wherein the inner valve cavity fluidly couples the first valve opening with the second valve opening;

a seal disposed within the valve body, the seal configured to be buoyant in a liquid, the seal being configured to remain stationary in relation to the valve body when a gas flows between the first valve opening and the second valve opening through the inner valve cavity, and the seal having a maximum seal cross-sectional dimension;

wherein the seal is operatively coupled within the valve body such that the seal is configured to move relative to the valve body between an open position, in which the seal allows the gas to flow between the first and second valve openings through the inner valve cavity, and a closed position, in which the seal inhibits the gas and the liquid from flowing through the inner valve cavity from the first valve opening to the second valve opening; and a base fixed within the valve body, wherein the base is configured to support the seal when the seal is in the open position, the base has at least one hole extending therethrough, the at least one hole is configured to allow the gas to flow between the first and second valve openings through the inner valve cavity, the base includes a base body, the base body has a maximum body cross-sectional dimension, the maximum seal cross-sectional dimension is less than the maximum body cross-sectional dimension, the at least one hole extends through a portion of the base that is outside the maximum body cross-sectional dimension such that the seal does not extend over the at least one hole when the seal is in the open position and sits on the base.

2. The dual flow check valve of claim 1, wherein the liquid is oil, and the seal is configured to be buoyant in oil.

3. The dual flow check valve of claim 1, wherein the seal is substantially hollow.

4. The dual flow check valve of claim 3, wherein the seal is a substantially hollow aluminum ball.

5. The dual flow check valve of claim 1, wherein the base has a plurality of holes each extending therethrough, each hole being configured to allow the gas to flow between the first and second valve openings through the inner valve cavity.

6. The dual flow check valve of claim 5, wherein a portion of the base is substantially disk-shaped.

7. The dual flow check valve of claim 6, wherein the plurality of holes are arranged circumferentially along the base.

8. The dual flow check valve of claim 1, further comprising at least one wall supported by a portion of the base, the at least one wall being disposed within the valve body such as to guide the movement of the seal when the seal moves between the open position and the closed position.

9. The dual flow check valve of claim 8, wherein the valve body defines an inner valve surface that defines at least the inner valve cavity, and the at least one wall is disposed between the inner valve surface and the seal.

10. A dual flow check valve comprising:

a valve body having an inner valve cavity, a first valve opening leading to the inner valve cavity, and a second valve opening leading to the inner valve cavity, wherein the inner valve cavity fluidly couples the first valve opening with the second valve opening;

a seal disposed within the valve body, the seal configured to be buoyant in a liquid, wherein the seal is configured to remain stationary in relation to the valve body when a gas flows between the first valve opening and the second valve opening through the inner valve cavity, the seal is operatively coupled within the valve body such that the seal is configured to move relative to the valve body between an open position, in which the seal allows the gas to flow between the first and second valve openings through the inner valve cavity, and a closed position, in which the seal inhibits the gas and the liquid from flowing through the inner valve cavity from the first valve opening to the second valve opening;

a base fixed within the valve body, wherein the seal sits on the base when the seal is in the open position, wherein the base defines a plurality of holes, the holes are spaced apart from the seal when the seal is in the open position and sits on the base so as to enable the gas to flow through the base when the seal is in the open position while the seal remains stationary relative to the valve body when the gas flows through the holes, and the base is disposed between the first valve opening and the second valve opening to enable the gas to flow from the first valve opening to the second valve opening via the holes when the seal is in the open position;

wherein the seal has a maximum seal cross-sectional dimension, and at least one of the holes is entirely disposed outside the maximum seal cross-sectional dimension when the seal sits on the base so as to allow the gas to flow through the base and around the seal when the seal is in the open position; and wherein the base includes a base body, the base body has a maximum body cross-sectional dimension, the maximum seal cross-sectional dimension is less than the maximum body cross-sectional dimension, the holes extend through a portion of the base that is outside the maximum body cross-sectional dimension such that the seal does not extend over the holes when the seal is in the open position and sits on the base.

11. The dual flow check valve of claim 10, wherein the seal has a seal density, the gas has a gas density, and the seal density is greater than the gas density in order to allow the seal to remain stationary relative to the valve body when the gas flows through the holes.

12. The dual flow check valve of claim 10, wherein an entirety of each of the plurality of holes is disposed outwardly relative to the seal when the seal is in the open position in order to allow bidirectional flow of the gas between the first valve opening and the second valve opening via the holes.

* * * * *